US008181335B2

(12) United States Patent
Milton et al.

(10) Patent No.: US 8,181,335 B2
(45) Date of Patent: May 22, 2012

(54) APPARATUS FOR ASSEMBLING A CORE FOR RECEIVING WOUND SHEET MATERIAL

(75) Inventors: Antony Stanley Milton, Worthing (GB); Sean Edward Greene, Rochester (GB)

(73) Assignee: Real Time Logistics Solutions, Inc., Paddock Wood (GB)

( * ) Notice: Subject to any disclaimer, the term of this patent is extended or adjusted under 35 U.S.C. 154(b) by 265 days.

(21) Appl. No.: 12/449,829

(22) PCT Filed: Feb. 6, 2008

(86) PCT No.: PCT/GB2008/000426

§ 371 (c)(1),
(2), (4) Date: Aug. 28, 2009

(87) PCT Pub. No.: WO2008/107629

PCT Pub. Date: Sep. 12, 2008

(65) Prior Publication Data

US 2010/0018037 A1 Jan. 28, 2010

(30) Foreign Application Priority Data

Mar. 2, 2007 (GB) ..... 0704114.8

(51) Int. Cl.
*B23Q 15/00* (2006.01)

(52) U.S. Cl. ..... 29/705; 29/709; 29/714; 29/718; 242/609.2; 242/609.1

(58) Field of Classification Search ..... 29/705, 29/709, 714, 718, 700, 251, 252, 253; 242/609.1, 242/609.2

See application file for complete search history.

(56) References Cited

U.S. PATENT DOCUMENTS

| | | | | |
|---|---|---|---|---|
| 1,858,753 | A | | 5/1932 | Taylor |
| 2,010,057 | A | * | 8/1935 | Buckwalter ..... 295/36.1 |
| 3,095,729 | A | * | 7/1963 | McConnell ..... 73/49.1 |
| 3,451,639 | A | | 6/1969 | Atwood et al. |
| 3,916,499 | A | * | 11/1975 | Frame et al. ..... 29/718 |
| 3,946,962 | A | | 3/1976 | Deletzke, Jr. |
| 4,557,029 | A | | 12/1985 | Stewart |
| 4,877,198 | A | | 10/1989 | Gershenson et al. |
| 5,154,046 | A | * | 10/1992 | Piccolo et al. ..... 59/7 |
| 5,340,050 | A | | 8/1994 | Renck |

(Continued)

FOREIGN PATENT DOCUMENTS

BE 384 225 A 12/1931

(Continued)

*Primary Examiner* — Essama Omgba
(74) *Attorney, Agent, or Firm* — Iandiorio Teska & Coleman, LLP

(57) ABSTRACT

Apparatus for assembling a core for wound sheet material, comprising a tube, a first end member, and a second end member; the apparatus comprising a base, a first chuck for insertion in the first end member, a second chuck for insertion in the second end member, a ram for applying axial pressure such that the first end member is forced into the first end of the tube and the second end member is forced into a second end of the tube, drill devices for drilling fixing apertures, and a monitor device for sensing ambient temperature and enabling the length of the core to be measured at the time of the assembly of the core in the ambient temperature so that the length of the core falls in temperature and length parameters set for subsequent winding of the sheet material on the core.

16 Claims, 2 Drawing Sheets

U.S. PATENT DOCUMENTS

| | | | | | |
|---|---|---|---|---|---|
| 5,469,619 | A | * | 11/1995 | Renck | 29/895.2 |
| 5,857,643 | A | * | 1/1999 | Czuprynski et al. | 242/613 |
| 2004/0113011 | A1 | | 6/2004 | Place | |

FOREIGN PATENT DOCUMENTS

| | | | | |
|---|---|---|---|---|
| DE | 23 62 485 | A1 | | 6/1975 |
| DE | 295 20 038 | U1 | | 2/1996 |
| DE | 203 16 500 | U1 | | 4/2004 |
| DE | 103 10 510 | A1 | | 5/2005 |
| EP | 0 227 625 | A | | 7/1987 |
| EP | 1 484 272 | A2 | | 12/2004 |
| FR | 336 801 | A | | 11/1903 |
| FR | 2 848 272 | A | | 6/2004 |
| GB | 1 319 171 | A | | 6/1973 |
| GB | 1 388 393 | A | | 3/1975 |
| JP | 2003 300675 | A | | 10/2003 |
| JP | 2004 269109 | A | | 9/2004 |
| WO | WO 86/05443 | A | | 9/1986 |
| WO | WO 03/040012 | | | 5/2003 |
| WO | WO 2006/043021 | A1 | | 4/2006 |
| WO | WO 2008/087379 | A1 | | 7/2008 |
| WO | WO 2008/099138 | A1 | | 8/2008 |
| WO | WO 2008107629 | A1 | * | 9/2008 |

* cited by examiner

APPARATUS FOR ASSEMBLING A CORE FOR RECEIVING WOUND SHEET MATERIAL

TITLE OF THE INVENTION

BACKGROUND OF THE INVENTION

This invention relates to apparatus for assembling a core for receiving wound sheet material.

Cores for receiving wound sheet material are well known. The cores are extensively used in the paper industry for receiving wound sheet material in the form of paper, plastics material or thin cardboard. Reels formed of the core and the wound sheet material are then used in printing works where the wound sheet material is printed, for example for purposes of producing newspapers, packaging or wrapping.

For the winding of the sheet material on the cores, it is essential that the cores are accurately produced in length. Small variations in core lengths have a cumulative effect when the cores are mounted end to end. If a plurality of cores are mounted end to end and wound with a single width of sheet material, then the sheet material has to be cut such that the cuts coincide exactly with the ends of each core. If the cuts do not coincide exactly with the ends of each core, then the wound sheet material can overlap two adjacent cores. The two adjacent cores then cannot be separated from each other because the overlaying sheet material holds the cores together.

The cores traditionally comprise a tube, a first end member inserted in a first end of the tube, and a second end member inserted in a second end of the tube. If the first and the second end members are not fully inserted into their tubes then the core will be of a length which is incorrect to start with. Also, the core will be of a length which will vary during use. For example, any axial pressure applied to a first or a second end member not fully inserted into its end of the tube would result in the first or the second end member moving slightly, with a subsequent variation in the overall length of the core. Reels comprising a core and wound sheet material are large and they are held in place during printing or other works by chucks which exert considerable axial pressure. Even if the first and the second end members are fastened in their ends of the tube by fasteners such for example as screws, the first and the second end members may still get pushed in axially by the considerable axial forces exerted from the holding chucks.

BRIEF SUMMARY OF THE INVENTION

It is an aim of the present invention to obviate or reduce the above mentioned problems.

Accordingly, the present invention provides apparatus for assembling a core for receiving wound sheet material: which core comprises a tube, a first end member inserted in a first end of the tube, and a second end member inserted in a second end of the tube; and the apparatus comprising a base, first chuck means mounted on the base and for insertion in the first end member, second chuck means mounted on the base and for insertion in the second end member, a ram mounted on the base and for applying axial pressure on one of the first and the second end members such that the first end member is forced into the first end of the tube and the second end member is forced into the second end of the tube thereby to ensure that the first and the second end members are accurately fitted in the tube, first drill means for drilling at least one fixing aperture in the first end of the tube and the first end member thereby to enable the fixing of the first end member in the first end of the tube, second drill means for drilling at least one fixing aperture in the second end of the tube and the second end member thereby to enable the fixing of the second end member in the second end of the tube, and monitor means for sensing ambient temperature and enabling the length of the core to be measured at the time of the assembly of the core in the ambient temperature and thereby to ensure that the length of the core falls in temperature and length parameters set for subsequent winding of the sheet material on the core.

The apparatus of the present invention is such that the use of the ram enables the first and the second end members to be inserted into the tube without the possibility of one or both of the end members not being fully inserted. Thus precision of insertion is achieved. The monitor means is able to sense the ambient temperature so that the expansion of the core if it is made of an expandable material is able to be checked and confirmed to be appropriate for subsequent set parameters. The monitor means is also able to measure the entire length of the assembled core, again to check that its length is within subsequent set parameters for subsequent winding of the sheet material on the core.

The apparatus may be one in which the first chuck means has a first abutment portion which abuts against the first end member, in which the second chuck means has a second abutment portion which abuts against the second end member, and in which the ram applies the axial pressure via the abutment portion on the first or the second end member.

The ram may apply the actual pressure on the first end member. Alternatively the ram may apply the axial pressure on the second end member. The axial force is easily transferred from one end member to the other end member, for example via the first and the second abutment portions on the first and the second chuck means respectively.

The apparatus may be one in which the first drill means comprises a sequence-controlled drilling motor, and in which the second drill means comprises a sequence-controlled drilling motor.

The first drill means may comprise a ram for moving the first drill means into and out of a drilling position, and the second drill means may comprise a ram for moving the second drill means into and out of a drilling position. The rams are preferably pneumatic rams. Other types of rams may however be employed so that, for example, the rams may be electrically-operated rams or hydraulically-operated rams.

Preferably, the monitor means enables the length of the core to be measured after the ram has applied the axial pressure, and before the first and the second drill means have drilled the fixing apertures. With such a use of the monitor means, any necessary adjustments can be effected before drilling takes place.

Preferably, the monitor means comprises an ambient temperature sensor, and an electronic length measuring device. The electronic length measuring device is preferably a Vernier displacement transducer.

The apparatus may include screw fixing means for screwing screws into the fixing aperture. Fixing devices other than screws may be employed if desired.

The apparatus may include tag sensing means for sensing if the core has an identity tag for use in identifying the core. The identity tag may be a radio frequency identification tag for enabling the core to be tracked from its place of manufacture to its place of use. The radio frequency identification tag may also provide information such for example as the amount of sheet material used up on the core at any one time, and the amount of times the core has been reused if the core is a re-usable core. The radio frequency identification tag is preferably an active tag transponder but it may be a passive tag transponder.

Preferably, there are two of the tag sensing means, there being a first one of the tag sensing means positioned adjacent the first end member for sensing a first tag on the first end member, and a second one of the tag sensing means positioned adjacent the second end member for sensing a second tag on the second end member. The use of two tags enables information to be obtained on which way the core is facing, so that, for example, a reel comprising the core and the wound sheet material can be correctly mounted on a printing machine so that the wound sheet material is able to be unwound during printing.

Preferably, the tag sensing means is mounted on the base. The sensing means may be mounted elsewhere if desired.

The apparatus may include antenna sensing means.

Preferably, the core is made of aluminum. The core may be made of other materials if desired so that, for example, the core may be made of other metals, plastics materials or cardboard.

Preferably, the first and the second end members are made of a plastics material. The first and the second end members are preferably moulded first and second end members. Typically the plastics material is polypropylene. Other plastics materials may be employed. The end members may be disposable end members or re-usable end members.

The core may be wound with any suitable any appropriate sheet material. Typically the sheet material is paper, plastics film or thin cardboard.

BRIEF DESCRIPTION OF THE SEVERAL VIEWS OF THE DRAWINGS

An embodiment of the invention will now be described solely by way of example and with reference to the accompanying drawings in which.

DETAILED DESCRIPTION OF THE INVENTION

Figure 1:
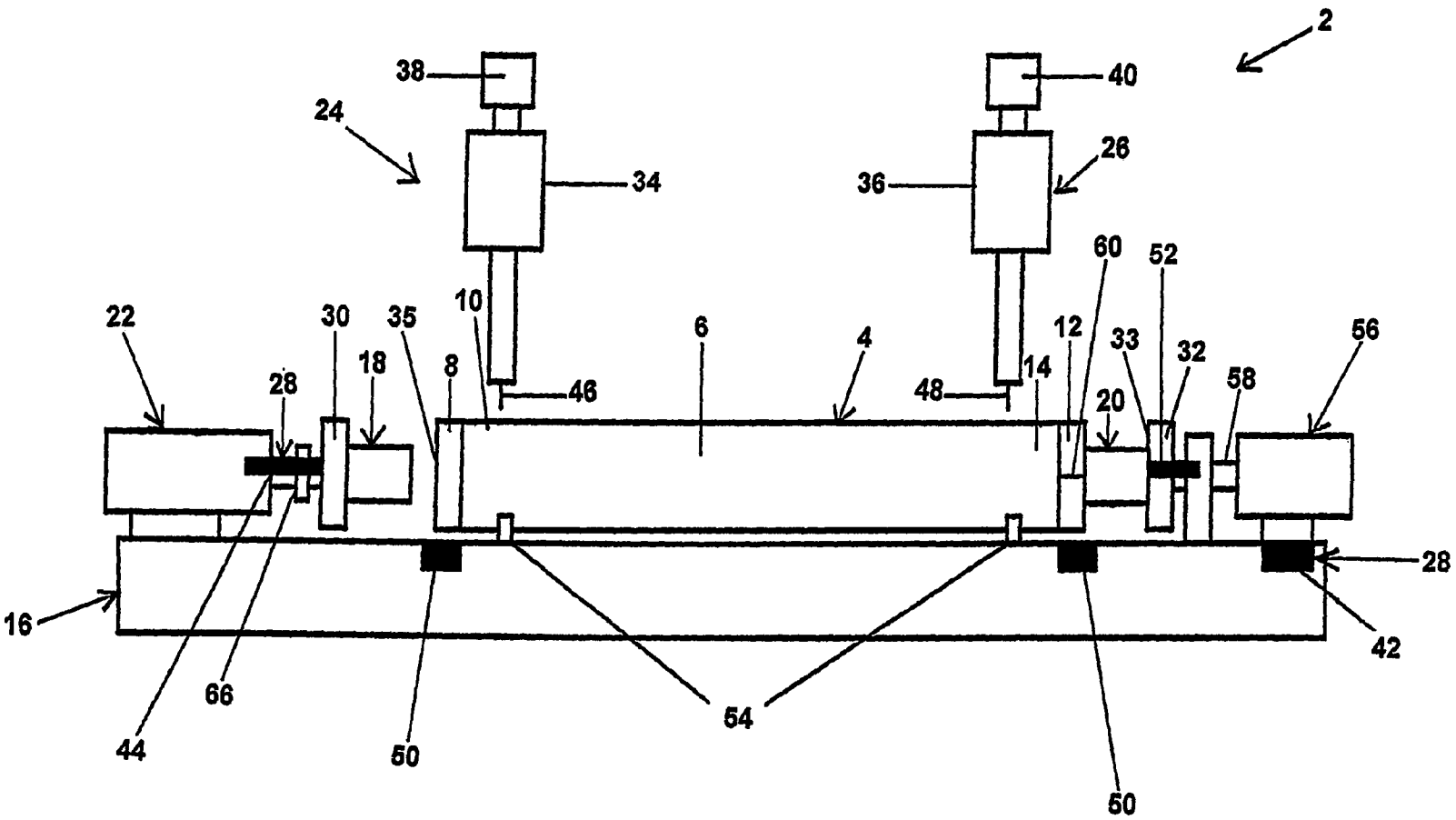
FIG. 1 shows apparatus of the present invention in use assembling a core for receiving wound sheet material.

Referring to the drawings, there is shown a machine 2 for assembling a core 4 for receiving wound sheet material (not shown).

The core 4 comprises a tube 6, a first end member 8 inserted into a first end 10 of the tube 6, and a second end member 12 inserted in a second end 14 of the tube 6.

The apparatus 2 comprises a base 16. The apparatus 2 also comprises first chuck means 18 mounted on the base 16 and for insertion in the first end member 8. The apparatus 2 further comprises second chuck means 20 mounted on the base 16 and for insertion in the second end member 12. A ram 22 is mounted on the base 16 and is for applying axial pressure on the first end member 8. In an alternative embodiment of the invention not shown, the ram 22 could apply axial pressure on the second end member 12. The effect of the axial pressure is such that the first end member 8 is forced into the first end 10 of the tube 6, and the second end member 12 is forced into the second end 14 of the tube 6. This ensures that the first and the second end members 8, 12 are accurately fitted in the tube 6.

The apparatus 2 further comprises first drill means 24 for drilling at least one fixing aperture in the first end 10 of the tube 6 and the first end member 8 thereby to enable the fixing of the first end member 8 in the first end 10 of the tube 6. The apparatus 2 further comprises second drill means 26 for drilling at least one fixing aperture in the second end 14 of the tube 6 and the second end member 12 thereby to enable the fixing of the second end member 12 in the second end 14 of the tube 6.

The apparatus 2 still further comprises monitor means 28 for sensing ambient temperature and enabling the length of the core 4 to be measured at the time of the assembly of the core 4 in the ambient temperature. This ensures that the length of the core 4 falls within temperature and length parameters set for subsequent winding of the sheet material on the core 4.

The first chuck means 18 has a first abutment portion 30 which abuts against the first end member 8. The second chuck means 20 has a second abutment portion 32 which abuts against the second end member 12. The ram 22 applies the axial pressure directly via the first abutment portion 30, and indirectly via the second abutment portion 32.

The first drill means 24 comprises a sequence-controlled drilling motor 34. The second drill means 26 comprises a sequence-controlled drilling motor 36.

The first drill means 24 comprises a ram 38 for moving the first drill means 24 into and out of a drilling position. The second drill means 26 comprises a ram 40 for moving the second drill means 26 into and out of a drilling position. The rams 38, 40 are pneumatic rams.

The monitor means 28 operates to enable the length of the core 4 to be measured after the ram has applied the axial pressure, and before the first and the second drill means 24, 26 have drilled the fixing apertures. In this way, appropriate checks can be made on the length of the core 4 whilst it is still possible to make adjustments without having to use replacement parts because existing parts have been incorrectly drilled and fixed in position. The monitor means 28 comprises an ambient temperature sensor 42, and an electronic length measuring device in the form of a Vernier displacement transducer 44. The Vernier displacement transducer 44 measures the distance from the fixed machined end face 33 of the second abutment portion 32 to the outer edge 35 of the first end member 8.

The apparatus 2 includes screw fixing means (not shown) for screwing screws into the fixing apertures formed by the first and the second drill means 24, 26. As shown in FIG. 1, the first drill means 24 has a drill 46, and the second drill means 26 has a drill 48.

The core 4 comprises two tag sensing means 50. A first one of the tag sensing means 50 is positioned adjacent the first end member 8 for sensing a first tag (not shown) on the first end member 8. The second one of the tag sensing means 50 is positioned adjacent the second end member 12 for sensing a second tag (not shown) on the second end member 12. The two tag sensing means 50 are mounted on the base 16 as shown. The tags are preferably radio frequency identification tags. Also preferably the radio frequency identification tags are active radio frequency identification tags having an antenna.

The tube 6 and therefore the core 4 is supported on support rollers 54. The support rollers 54 are mounted on the base 16.

The tube 6 is made of aluminum. The first and the second end members 8, 12 are moulded from a plastics material. The first and the second end members 8, 12 are replaceable end members.

The apparatus 2 further comprises a sequence-controlled drive motor 56 operating a drive shaft 58. The drive motor 56 is mounted on the base 16 as shown. The drive motor 56 operates to rotate the second chuck means 20. The first chuck means 18 is a free run chuck means 18 which rotates on a bearing 66. The drive motor 56 is thus able to rotate the core 4 as desired for assembly purposes. During drilling, the drilled holes will preferably be counter-sunk holes.

The apparatus 2 also includes antenna sensing means 52. In FIG. 1, the antenna sensing means 52 is shown as able to sense a tag antenna 60. The sensing of the antenna 60 by the antenna sensing means 52 enables the rotational position of the tube 6 accurately to be known for the hole-drilling and subsequent screw-fixing purposes. More specifically, the antenna sensing means 52 finds the position of the antenna 60 and so an accurate operation starting point can be established which is at 90° to an adjacent drilling head. The tube 6 can then accurately be rotated through 90° increments to allow for the drilling of the holes and the insertion of fixing screws in the holes.

Figure 4:
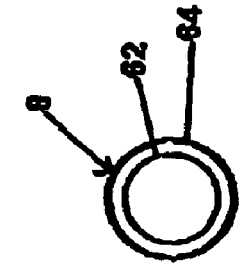
FIG. 4 is an end view of the right hand end member shown in FIG. 3.
Figure 3:
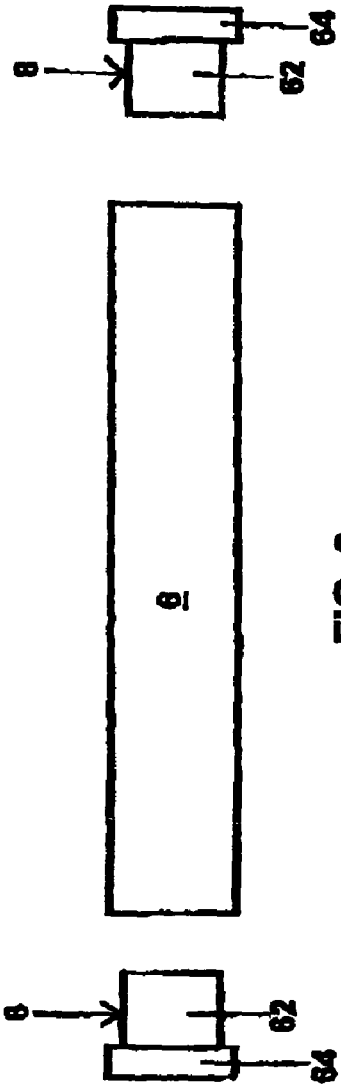
FIG. 3 is an exploded view of the core as shown in FIG. 2.
Figure 2:
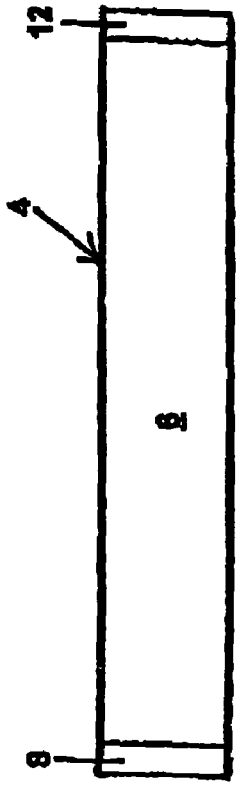
FIG. 2 shows the core of FIG. 1.

FIGS. 2, 3 and 4 show in more detail the formation of the core 4. As can best be seen from FIGS. 3 and 4, the first and the second end members 8, 12 have an insert portion 62 which goes inside the tube 6, and a flange portion 64 which abuts against the end of the tube 6.

It is to be appreciated that the embodiment of the invention described above with reference to the accompanying drawings has been given by way of example only and that modifications may be effected. Thus, for example, the positioning of the drive motor 56 and the ram 22 may be reversed. The tube 6 may be of a wide variety of different lengths. During winding of the wound sheet material on the core 4, a plurality of cores of different lengths may be mounted in a line and then wound with sheet material which is cut by slitting so that the slits coincide exactly with the ends of the cores 4.

The invention claimed is:

1. An Apparatus for assembling a core for receiving wound sheet material: which core comprises a tube, a first end member inserted in a first end of the tube, and a second end member inserted in a second end of the tube; and the apparatus comprising a base, first chuck means mounted on the base and for insertion in the first end member, second chuck means mounted on the base and for insertion in the second end member, a ram mounted on the base and for applying axial pressure on one of the first and the second end members such that the first end member is forced into the first end of the tube and the second end member is forced into the second end of the tube thereby to ensure that the first and the second end members are accurately fitted in the tube, first drill means for drilling at least one fixing aperture in the first end of the tube and the first end member thereby to enable the fixing of the first end member in the first end of the tube, second drill means for drilling at least one fixing aperture in the second end of the tube and the second end member thereby to enable the fixing of the second end member in the second end of the tube, and monitor means for sensing ambient temperature and enabling the length of the core to be measured at the time of the assembly of the core in the ambient temperature and thereby to ensure that the length of the core falls in temperature and length parameters set for subsequent winding of the sheet material on the core.

2. The apparatus according to claim 1 in which the first chuck means has a first abutment portion which abuts against the first end member, in which the second chuck means has a second abutment portion which abuts against the second end member, and in which the ram applies the axial pressure via the abutment portion on the first or the second end member.

3. The apparatus according to claim 1 in which the ram applies the axial pressure on the first end member.

4. The apparatus according to claim 1 in which the first drill means comprises a sequence-controlled drilling motor, and in which the second drill means comprises a sequence-controlled drilling motor.

5. The apparatus according to claim 1 in which the first drill means comprises a ram for moving the first drill means into and out of a drilling position, and in which the second drill means comprises a ram for moving the second drill means into and out of a drilling position.

6. The apparatus according to claim 5 in which the rams are pneumatic rams.

7. The apparatus according to claim 1 in which the monitor means enables the length of the core to be measured after the ram has applied the axial pressure, and before the first and the second drill means have drilled the fixing apertures.

8. The apparatus according to claim 1 in which the monitor means comprises an ambient temperature sensor, and a length measuring sensor.

9. The apparatus according to claim 1 and including screw fixing means for screwing screws into the fixing apertures.

10. The apparatus according to claim 1 and including tag sensing means for sensing if the core has an identity tag for use in identifying the core.

11. The apparatus according to claim 10 and in which there are two of the tag sensing means, there being a first one of the tag sensing means positioned adjacent the first end member for sensing a first tag on the first end member, and a second one of the tag sensing means positioned adjacent the second end member for sensing a second tag on the second end member.

12. The apparatus according to claim 10 in which the tag sensing means is mounted on the base.

13. The apparatus according to claim 10 and including antenna sensing means.

14. The apparatus according to claim 1 in which the core is made of aluminlum.

15. The apparatus according to claim 1 in which the first and the second end members are made of a plastics material.

16. The apparatus according to claim 1 in which the end members are disposable end members or re-usable end members.

* * * * *